US008677917B2

(12) United States Patent
Elizondo

(10) Patent No.: US 8,677,917 B2
(45) **Date of Patent: *Mar. 25, 2014**

(54) INTERCHANGEABLE SUPERSTRUCTURES AND HULLS FOR OCEAN GOING VESSELS

(76) Inventor: Luis Daniel Elizondo, Stevensville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/556,885

(22) Filed: Jul. 24, 2012

(65) Prior Publication Data

US 2012/0285363 A1 Nov. 15, 2012

Related U.S. Application Data

(63) Continuation of application No. 13/024,216, filed on Feb. 9, 2011, now abandoned, which is a continuation of application No. 12/364,714, filed on Feb. 3, 2009, now abandoned, which is a continuation of application No. 11/705,497, filed on Feb. 13, 2007, now Pat. No. 7,487,735.

(60) Provisional application No. 61/007,930, filed on Feb. 13, 2006.

(51) Int. Cl.
*B63B 3/02* (2006.01)

(52) U.S. Cl.
USPC ..... 114/65 R; 114/77 A

(58) Field of Classification Search
USPC ..... 115/56.1, 65 R; 114/56.1, 65 R, 77 R, 114/77 A
See application file for complete search history.

(56) References Cited

U.S. PATENT DOCUMENTS

| | | | | | |
|---|---|---|---|---|---|
| 685,591 | A | * | 10/1901 | Fernez et al. | 440/91 |
| 1,069,692 | A | * | 8/1913 | Harrison | 114/77 A |
| 2,371,149 | A | * | 3/1945 | Bylo | 414/140.6 |
| 3,371,639 | A | * | 3/1968 | Schillreff | 114/77 A |
| 3,962,984 | A | | 6/1976 | Beghin | |
| 4,072,120 | A | | 2/1978 | Bylo | |
| 4,766,829 | A | | 8/1988 | Schlichthorst | |
| 5,417,597 | A | | 5/1995 | Levedahl | |
| 5,483,910 | A | | 1/1996 | Skaarub et al. | |
| 7,231,880 | B2 | | 6/2007 | Schmidt et al. | |
| 7,487,735 | B2 | | 2/2009 | Elizondo | |

* cited by examiner

*Primary Examiner* — Stephen Avila
(74) *Attorney, Agent, or Firm* — Mattingly & Malur, PC

(57) ABSTRACT

An ocean going vessel with interchangeable superstructure and hull in which the superstructure has control units for controlling propulsion and steering, as well as components for communication and navigation. The superstructure and the hull each have an interface providing quick connect and disconnect capability between the control units of the superstructure and the components being controlled of the hull. A system for interchanging superstructures and hulls for ocean going vessels is enabled in which the superstructure of an inbound vessel is removed and transferred to an outbound hull with the use of a crane at the port facility. This facilitates quick turnaround time of the superstructure and crew of the inbound vessel. This also enables inbound ship hulls to be inspected without delaying the outbound hull that has been preloaded from being shipped out of port with the transferred superstructure.

6 Claims, 4 Drawing Sheets

INTERCHANGEABLE SUPERSTRUCTURES AND HULLS FOR OCEAN GOING VESSELS

This application is a continuation of U.S. patent application Ser. No. 13/024,216, filed Feb. 9, 2011, now abandoned, which is a continuation of U.S. patent application Ser. No. 12/364,714, now abandoned, filed Feb. 3, 2009, which is a continuation of U.S. patent application Ser. No. 11/705,497, filed Feb. 13, 2007, now U.S. Pat. No. 7,487,735, the contents of which are hereby incorporated by reference into this application. This application claims priority from U.S. Ser. No. 61/007,930 filed Feb. 13, 2006.

BACKGROUND OF THE INVENTION

1. Field of the Invention

This invention relates to interchangeable superstructures and hulls for ocean going vessels and a system of superstructures and hulls that are interchangeable for forming ocean going vessels.

2. Description of the Related Art

Upon arrival into a port, current shipping procedures require providing ample time to both unload and then reload a vessel with goods (container ships) or liquids (LPG, oil, etc.). Unloading and loading a vessel is extremely labor intensive and time consuming, resulting in down time for a ship and its crew. With the prior art port procedures governing unloading of ships, there is an increased burden to U.S. Homeland Security and U.S. Customs inspectors due to compressed scheduling and maintaining oversight of crew members of foreign carriers who must wait for the contents of the ship to be unloaded before being able to return to sea. Current requirements to unload and reload a vessel demand maximum resources and also require a vessel to remain docked for extended periods of time. The result of this process is slower turn-around time, leading to higher costs of goods or commodities and lost profits for the shipping industry.

BRIEF SUMMARY OF THE INVENTION

An ocean going vessel according to the invention has an interchangeable superstructure that is readily coupled to a separate hull to form a vessel combination of superstructure and hull. The superstructure is able to be used for voyages and then uncoupled from the hull at a port to be useable with another hull.

A system of the invention uses such vessels to allow a superstructure to be removed from an inbound hull to a port, and then be coupled to another hull, which is already loaded and outbound from the port at which the inbound hull is left for port unloading operations and inspections. This decreases the turn around time of ocean transport to only that which is necessary to remove an existing superstructure from an inbound hull and couple the same superstructure to another hull that is outbound.

This also minimizes the time required for a ship and its crew to remain in port since the inbound hull can be unloaded at the port without requiring the crew to remain. Thus, the efficiency of the shipping industry is increased. Further, additional port time is provided for inspections of the contents of the inbound hull, which addresses U.S. Homeland Security concerns.

The superstructure of the invention has all necessary equipment for safe navigation, communication and piloting of the vessel, and further the superstructure has a lower portion that allows for safe, secure, and rapid attachment and detachment onto a correspondingly provided hull once in port.

The hull of the invention has all necessary equipment for propulsion. Further, the hull has a portion on the deck that allows for safe, secure and rapid attachment and detachment of the superstructure once in port.

DETAILED DESCRIPTION OF THE INVENTION

Records of existing dock manifests indicate the time required to off-load and reload an ocean going vessel, such as a large cargo or container/liquid container vessel varies but may require several days or even weeks to execute. In addition, extensive coordination must be conducted both prior to and during arrival before loading operations can begin. If goods and commodities are not off-loaded in a precise and efficient manner, costly delays can ensue, ultimately preventing other inbound vessels from docking on time.

Cargo vessels are particularly susceptible to fluctuations in port schedules and the shipping industry bases its revenue upon the amount of goods delivered and the number of voyages completed. Accordingly, increasing the efficiency of handling port operations such as loading and unloading the cargo can greatly increase revenue in the shipping industry. Further, the U.S. Department of Homeland Security, specifically the U.S. Immigration and Customs Enforcement Agency, is integrally involved in the operations of each foreign carrier that arrives in a U.S. port. Both the cargo and crew are subject to inspection. Due to compressed time scheduling and unplanned factors, often a thorough inspection is not feasible, leaving the port and the U.S. as a whole susceptible to national security threats. The said invention is intended to minimize turn-around time, increase overall volume of U.S. and international trade, and help mitigate threats to National Security.

By utilizing an "assembly line" approach that is initiated with removal of the superstructure upon arrival rather than the cargo/commodity, a vessel can begin its next voyage within hours instead of days. Once a superstructure is removed from its hull, the hull can be relocated and off-loaded in a standardized manner that maximizes efficiency while not utilizing valuable dock space or interfering with turn-around time. Also, U.S. federal law enforcement officials can maximize the time required to inspect cargo that would otherwise be lost if a vessel was pending other actions. Once off-loaded, the hull can be inspected, reloaded and made ready for the next superstructure. A strategic benefit will be a significant increase in the volume of arriving and departing goods, resulting in increased port business, employment of personnel, and annual tax revenue. By significantly decreasing the turn-around time, the number of voyages per year, per ship may increase by as much as 50%, stimulating international trade, increasing gross national product, and impacting the overall global economy in a positive manner.

Figure 1:
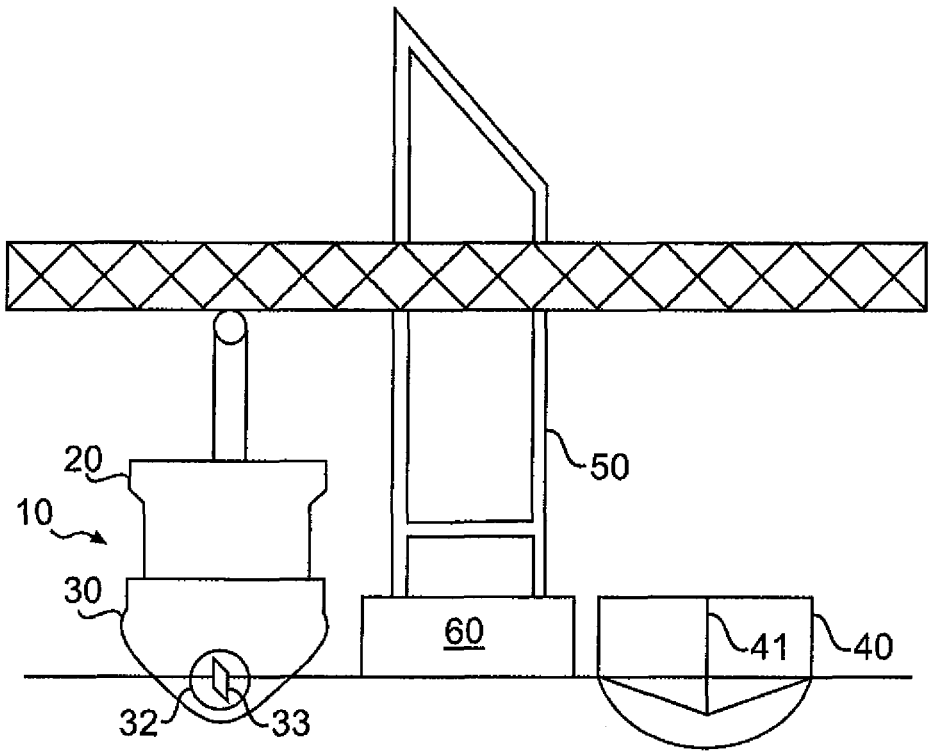
FIG. 1 illustrates a partial front view of an ocean going vessel of the invention at a port with a superstructure fixed to its inbound hull, and positioned aside an outbound hull without a superstructure.

Referring to FIG. 1, there is shown an ocean going cargo vessel 10 formed of an inbound hull 30 and a superstructure 20 secured at a dock 60. Situated adjacent to the cargo vessel 10 is a standard heavy-lift crane apparatus 50. The vessel's load includes shipping containers (not shown) and is awaiting off-loading. Although containers are used as an example for this illustration, the vessel may also be a liquid container ship or have other cargo. The superstructure 20 is awaiting removal by the adjacent crane apparatus 50. The superstructure and hull are both specifically designed for rapid attachment and detachment.

Figure 2:
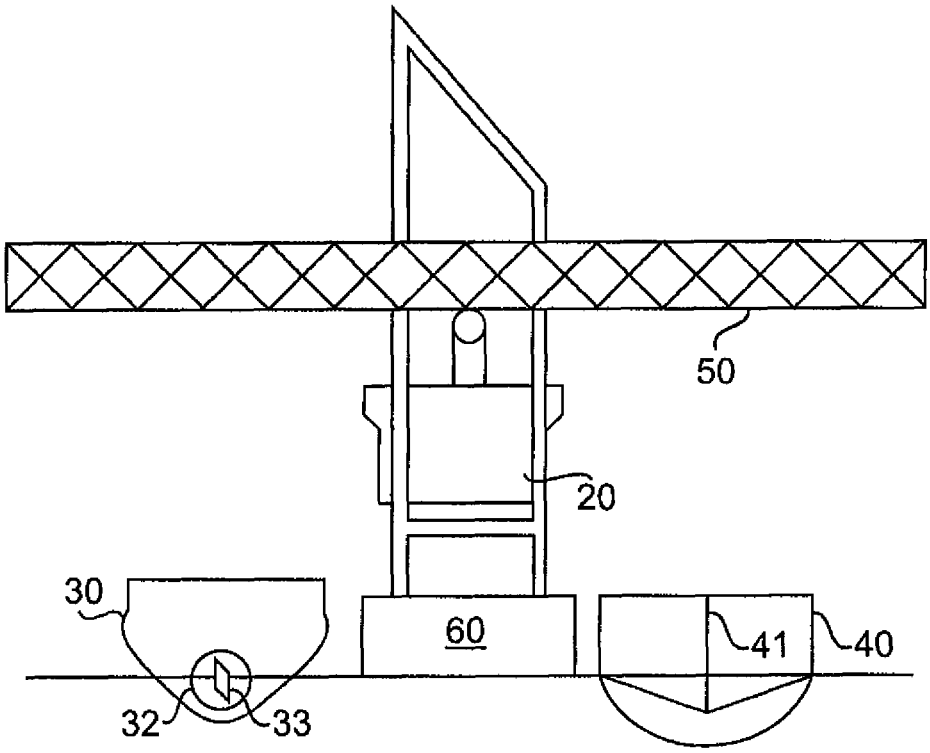
FIG. 2 illustrates a partial front view of the system of the invention in which a superstructure has been removed from one inbound hull and is being moved by crane to an outbound hull.

FIG. 2 is useful to explain the system of the invention which involves the interchangeable superstructures and hulls. Specifically, FIG. 2 shows an inbound cargo vessel hull 30 secured to a dock 60 without the superstructure 20. Situated adjacent to the cargo vessel 30 is an outbound hull 40. Both hulls (30, 40) include shipping containers. The inbound hull 30 is awaiting off loading and the outbound hull 40 has been preloaded and is awaiting the superstructure 20. Accordingly, the system includes both hulls and a single superstructure, but this is just for purposes of illustration, and in practice many superstructures and hulls would be operational in the system which would extend throughout many ports.

Figure 3:
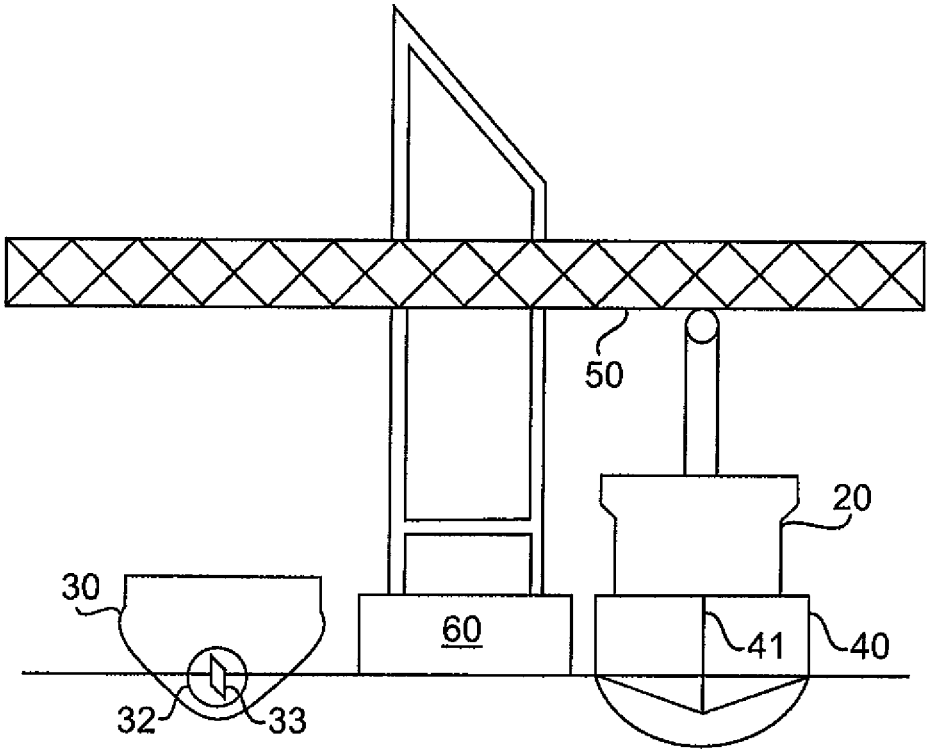
FIG. 3 illustrates a partial front view of the ocean going vessel with a superstructure fixed to the outbound hull.

FIG. 3 shows the standard heavy-lift crane apparatus 50 used to remove the superstructure from the inbound hull 30 and place it on an outbound hull 40. Adjacent to the crane apparatus is the outbound hull 40 complete with superstructure (making the vessel complete). The vessel's load includes shipping containers, for example. The superstructure is awaiting authorization for embarkation, for example.

Figure 4:
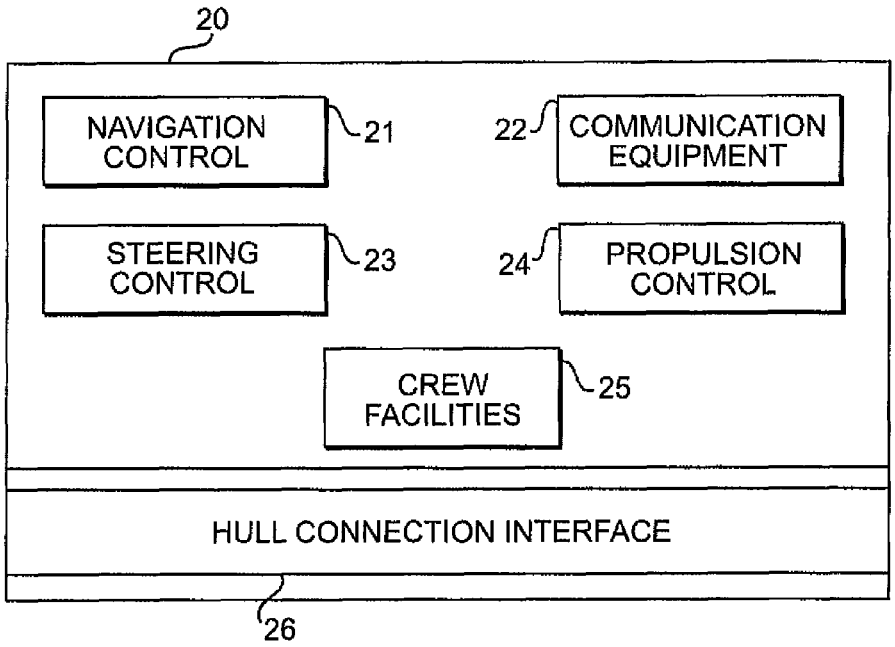
FIG. 4 is a block diagram of components of the superstructure of the present invention.

FIG. 4 shows a block diagram of the components of a superstructure 20 according to the invention. The superstructure 20 has navigational control 21, communication equipment 22, steering controls 23 and propulsion controls 24 in the helm of the superstructure. Additionally, crew facilities 25 are provided for the crew, including typical arrangements provided for a crew such as a head, galley, recreational facilities and sleeping quarters. In addition, superstructure 20 has a hull connection interface 26 through which the superstructure can be readily connected to or coupled with one of the hulls 30, 40.

Included within the hull connection interface are quick-connect couplings for connecting the navigation controls to the navigation equipment on the hull, such as a radar dome, etc. and the required lighting for the ship. Also included are quick-connect couplings from the steering controls 23 to the rudder 33 and from the propulsion controls 24 to the propulsion unit of the hull, which includes the engine and transmission 34 and propellers 32. Connection supporting the communication equipment is also included as necessary for establishing connection between the superstructure and the hull through the interface connections.

Figure 5:
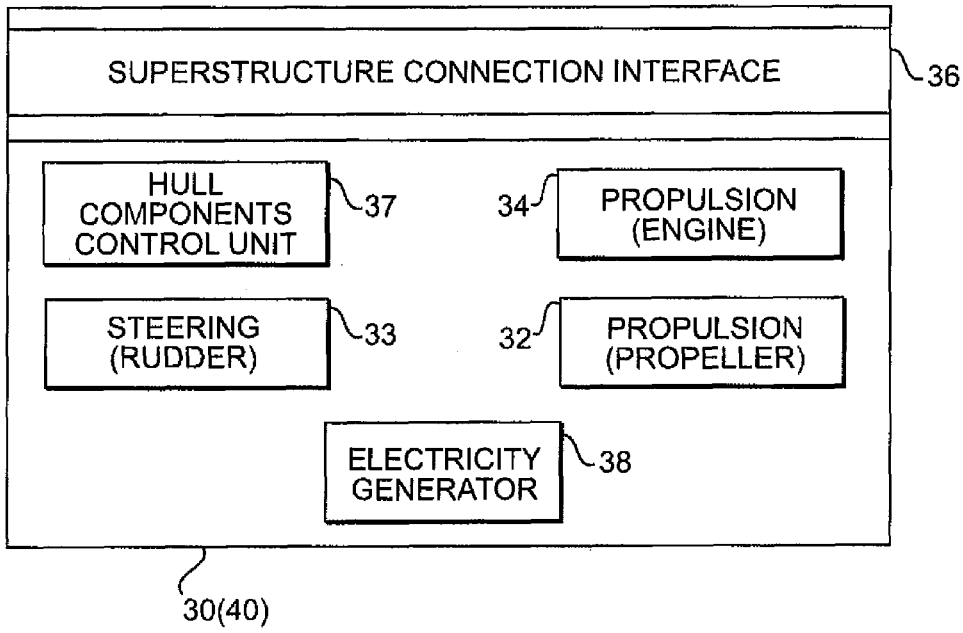
FIG. 5 is a block diagram of components of the hull of the present invention.

The hull of the present invention, as shown in block diagram form in FIG. 5, includes a propulsion unit 34, such as an engine and transmission combination for powering the propellers 32, a rudder 33. The engine typically runs from a source of fuel that is stored in fuel tanks in the hull. Further, an electric power generator 38 is contained in the hull and provides electric power for the various components of the ship included as part of the hull, and included as part of the superstructure.

The top deck of the hull has a superstructure connection interface 36 that is designed to couple with the hull connection interface 26 of the superstructure. Through the coupling of the interfaces 26, 36, the operations associated with navigation, communication, steering and propulsion control can be operated from the superstructure. Further, the hull component control unit 38 can operate the functions associated with loading and unloading cargo and otherwise maintaining the hull and the cargo of the hull, even when the superstructure is not in place. For example, the control unit 38 is able to control distribution of electric power to refrigeration units, ventilation equipment control and navigational light control, as well as operate bilge pumps and other sensors for maintaining safe operation of the hull even when the superstructure is not attached to the hull.

For attaching the superstructure to the hull, threaded bolt and nut connections around the peripheral of the superstructure can be provided. For example, upstanding bolts on the deck of the hull can be aligned with mounting holes on the superstructure and the superstructure can then be secured by tightening fastening nuts onto the threaded bolds. Further, secure clamping devices operated mechanically or hydraulically can be placed in load-supporting positions of the superstructure for coupling the superstructure to the hull, for example at the corners of the superstructure and at selected coupling points distributed throughout the footprint of the superstructure. Once the superstructure is coupled to the hull through mechanical connection, the mechanical connection is secured against accidental uncoupling through a mechanical interlock such as a threaded connection.

Further, the connecting process of the superstructure to the hull involves making electrical connections for navigation control and communication equipment which can be connected through wiring harnesses, for example. Each of the respective superstructure and hull structure has quick connection fittings for electric wires and plumbing connections. For example, linkages that are required between the steering control of the superstructure and the hull can be adapted for quick disconnection as well as linkages required for propulsion control. Still further, fiber optic couplings are usable for enabling connections of control equipment from the control units provided in the superstructure to the components provided in the hull. Other connections between the superstructure and hull can be made with quick disconnect couplings, and similar components of known construction so that the superstructure can be connected to and disconnected from the hull relatively simply and with a minimum of skilled labor.

The invention claimed is:

1. An ocean going vessel adapted for loading and unloading at a port facility, comprising:

said ocean going vessel having an interchangeable superstructure and hull, said superstructure having control units for controlling propulsion and steering;

said hull having propulsion and steering components that are controlled by said control units;

said hull having a horizontal deck entirely above a waterline on which said superstructure is mounted;

said hull having a first connection interface on the deck of said hull that has first quick connect and disconnect couplings; and said superstructure having a base and a second connection interface having second quick connect and disconnect couplings, wherein said base of said superstructure mounts on said deck and said second quick connect and disconnect couplings of said second connection interface of said superstructure connect and disconnect with the first quick connect and disconnect couplings of said first connection interface of said hull, enabling multiple times of quick connect and disconnect mounting of the superstructure on the deck of the hull, and multiple times of quick connect and disconnect coupling between the control units of the superstructure and the components of the hull being controlled, and wherein said superstructure is removed from the hull of said ocean going vessel at a port facility in accordance with at least one of said loading and unloading of said ocean going vessel.

2. An ocean going vessel adapted for loading and unloading at a port facility according to claim 1, further comprising said superstructure having electronic components for navigation and crew support areas for a crew of the vessel.

3. An ocean going vessel adapted for loading and unloading at a port facility according to claim 2, further including a crane at a port facility wherein said superstructure is removed from said hull of an inbound said ocean going vessel prior to unloading of said ocean going vessel.

4. An ocean going vessel adapted for loading and unloading at a port facility according to claim 1, wherein the cargo is unloaded from said hull without said superstructure being mounted on said hull.

5. An ocean going vessel adapted for loading and unloading at a port facility according to claim 1, wherein the cargo is loaded into said hull without said superstructure being mounted on said hull.

6. An ocean going vessel adapted for loading and unloading at a port facility according to claim 1, further comprising:

said hull having propulsion and steering components that are controlled by said control units including an engine, rudder, and sonar dome.

* * * * *